US008705234B2

(12) United States Patent
Schneider

(10) Patent No.: US 8,705,234 B2
(45) **Date of Patent: *Apr. 22, 2014**

(54) ANSWER BRACELET

(76) Inventor: Cole Patrick Schneider, Orlando, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/135,876

(22) Filed: Jul. 18, 2011

(65) Prior Publication Data

US 2012/0211940 A1 Aug. 23, 2012

Related U.S. Application Data

(63) Continuation-in-part of application No. 12/932,274, filed on Feb. 23, 2011, now Pat. No. 8,432,687.

(51) Int. Cl.
*G06F 1/16* (2006.01)

(52) U.S. Cl.
USPC ..... 361/679.55; 361/807; 361/679.02; 361/679.03; 361/679.09; 361/679.4

(58) Field of Classification Search
USPC ..... 361/807, 809, 810, 679.01, 679.02, 361/679.03, 679.09, 679.4, 679.55
See application file for complete search history.

(56) References Cited

U.S. PATENT DOCUMENTS

| | | | | |
|---|---|---|---|---|
| 4,060,971 | A * | 12/1977 | O'Connor et al. | 368/29 |
| 2002/0105859 | A1* | 8/2002 | Davidson et al. | 368/13 |
| 2005/0152227 | A1* | 7/2005 | Saunier | 368/282 |
| 2006/0114752 | A1* | 6/2006 | Saunier | 368/281 |
| 2011/0096481 | A1* | 4/2011 | Ueno | 361/679.01 |
| 2011/0149378 | A1* | 6/2011 | Park | 359/296 |
| 2011/0149716 | A1* | 6/2011 | Cho et al. | 370/205 |
| 2011/0319024 | A1* | 12/2011 | Fish | 455/41.3 |
| 2012/0069716 | A1* | 3/2012 | Peng | 368/10 |
| 2012/0081852 | A1* | 4/2012 | Maravilla et al. | 361/679.03 |

* cited by examiner

*Primary Examiner* — Hoa C Nguyen

(57) ABSTRACT

An answer bracelet suitable for wearing an a person's wrist. A rigid hollow housing having a transparent top cover is attached to a wrist band and houses a digital display, a microprocessor, a printed circuit board, a start switch, a tilt switch, a battery power supply and an audio emitting device. A digital display can be seen through the transparent top cover. When a user presses the start button and shakes the bracelet, the tilt switch sends a signal to the microprocessor whereupon the microprocessor causes the audio device to produce a short beep sound and then randomly selects one of a plurality of messages stored in the microprocessor and displays the message on the digital display for a predetermined period of time. Then the message disappears making the bracelet display ready for the next use. An alternate embodiment allows for an audio message to be heard as well as a visual message to be seen.

7 Claims, 4 Drawing Sheets

ANSWER BRACELET

This application is a continuation-in-part of U.S. application Ser. No. 12/932,274, filed Feb. 23, 2011, now U.S. Pat. No. 8,432,687.

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of wrist worn display devices and more specifically to an electronic digital answer bracelet.

Bracelets of all types are commonly worn on the wrist portion of a person's arm. Watches also are commonly worn on the wrist portion of a person's arm. Another popular device that has been used by people for many years is a product called an answer ball. It is traditionally designed to resemble an eight ball from the game of pool. Inside the hollow spherical shape a multifaceted tetrahedron floats in an opaque liquid. Each facet of the tetrahedron shape has a message printed on it. The spherical shell is opaque except for one window where the user can see one facet of the tetrahedron shape as it makes contact with the window thereby displacing the opaque fluid inside the sphere. To get an answer, the user shakes the ball and one of the facets presents itself to the user thereby giving the user a message that has been printed on that facet.

Although the answer ball has proved to be a well received novelty item that has endured for many years, it has certain deficiencies.

The main one being that the ball is rather heavy and bulky and therefore can not be easily transported by the user. The user may wish to have access to such a device for receiving an answer to a question while traveling, shopping or in any location away from home making the ball inconvenient to use. The other deficiency is that the answer ball provides a fixed and limited amount of flat surfaces to print messages on. Therefore it can not store relatively large numbers of answers.

BRIEF SUMMARY OF THE INVENTION

The primary object of the invention is to provide a bracelet that includes a digital display and that shows one of a plurality of pre programmed answer messages which appear after the user has shaken the bracelet.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an answer bracelet comprising: an approximately circular bracelet band suitable for wearing an a person's wrist, a digital display, a microprocessor, a printed circuit board, a momentary start switch, a motion detecting tilt switch, a battery power supply, an audio emitting device, a top cover portion, a bottom cover portion, said bracelet band having a hollowed out portion, said digital display mounted on said printed circuit board and residing in said hollow portion of said bracelet band, said top cover portion attached to said bracelet band so that it covers the said hollowed out portion, said momentary start switch mounted on said printed circuit board and residing in said hollow portion of said bracelet band to one side of said digital display, said microprocessor mounted to said printed circuit board and residing in said hollow portion of said bracelet band under said digital display, said battery power supply residing in said hollow portion of said bracelet under said microprocessor and accessible by removing said bottom cover portion, said audio emitting device mounted on said printed circuit board and residing in said hollow portion inside said bracelet band, said top cover including an aperture for allowing said audio sound to escape, said motion sensing tilt switch mounted to said printed circuit board and electrically wired to said microprocessor, so that when a user presses said start button and shakes said bracelet, said tilt switch sends a signal to said audio emitting device causing a short burst of sound and then said microprocessor randomly selects one of a plurality of messages stored in the memory portion of said microprocessor and displays said message on said digital display for a predetermined period of time and then said message disappears making said bracelet display ready for the next use. In one embodiment an audio voice recording of the answer is also activated along with the visual digital message.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
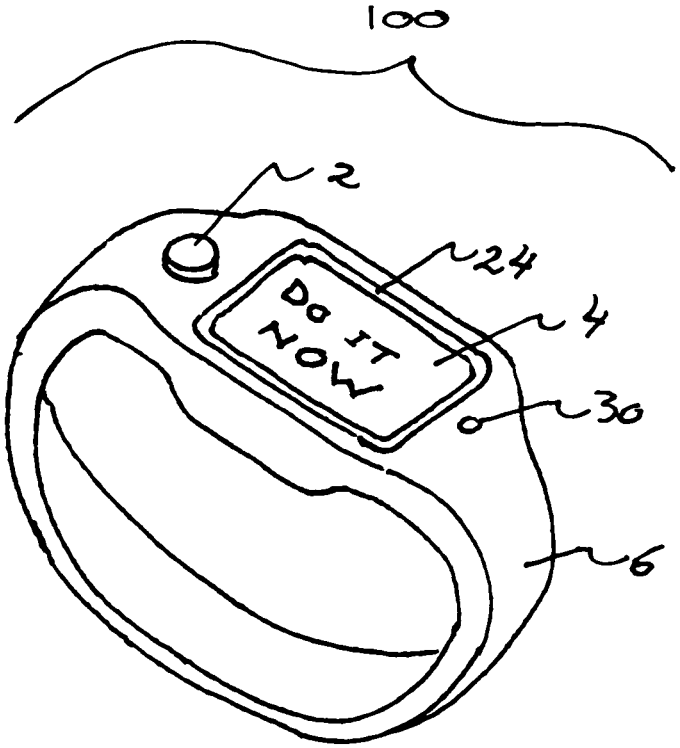
FIG. 1 is a perspective view of the invention.
Figure 2:
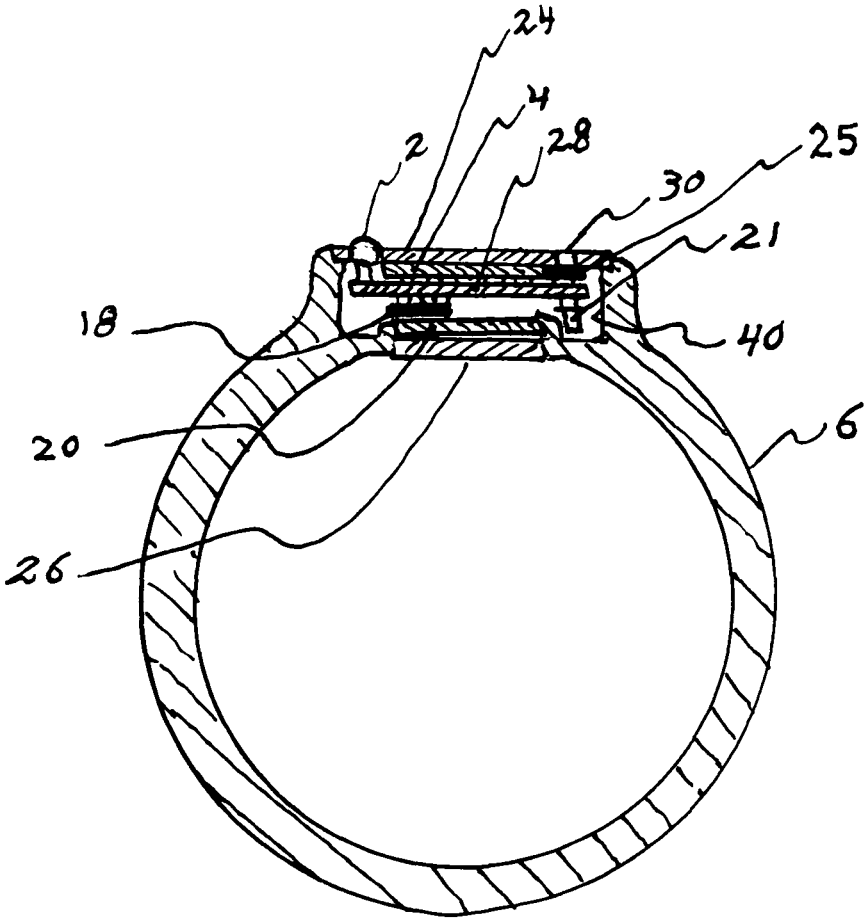
FIG. 2 is a side section view of the invention.

Referring now to FIGS. 1 and 2 we see a perspective view of the invention 100 and a side section view of the invention respectively. A bracelet 6 includes a top portion that has a digital display 4 residing in hollow housing 40 and covered by top cover 24. The user wears the bracelet 6 on his or her wrist like a wrist watch. When the user wishes to get an answer to a question, he or she presses on momentary start switch 2 and then shakes the bracelet 6 causing an internal motion detecting tilt switch 21 to close a circuit, letting microprocessor 18 know that the user wishes to have an answer. After a few seconds, the microprocessor 18 instructs a sound making device such as miniature speaker 25, to emit an audio tone, such as a beep, through aperture 30 in the top of the bracelet. When the tone stops, a message stored within the memory portion of microprocessor 18 appears on display 4. After a predetermined time, the message disappears so that the device 100 is ready for the next use. The digital display 4 can revert to a traditional digital watch display when not being used as an answer delivery device. When the answer feature is not in use, the digital display can act as a standard digital time keeping device.

In an alternate embodiment, instead of an audio tone being generated by the miniature speaker 25, an actual audio message, matching the message in the digital display 4, is played through the miniature speaker 25. The audio message has been pre-programmed into microprocessor 18 and is sent at the same time as the digital visual message that appears on LCD display 4. Alternately, the answer watch can produce and audio message only, without a visual message. Although the digital watch feature can be retained.

Referring particularly to the side section view in FIG. 2, hollowed out portion 40 contains within it a printed circuit board 28 topped by the digital display 4, which in the preferred embodiment is an LCD type display due to its low cost and low power consumption. momentary start switch 2 is mounted next to display 4 and is accessible through an aperture in the top cover 24. A motion detector tilt switch 21 is wired to the microprocessor 18. Miniature speaker 25 is mounted to the right of LCD display 4. Sound exits through aperture 30 located in the housing top cover 24. Battery 20 is located under the microprocessor 18 and is accessible through a removable bottom panel 26.

Figure 3:
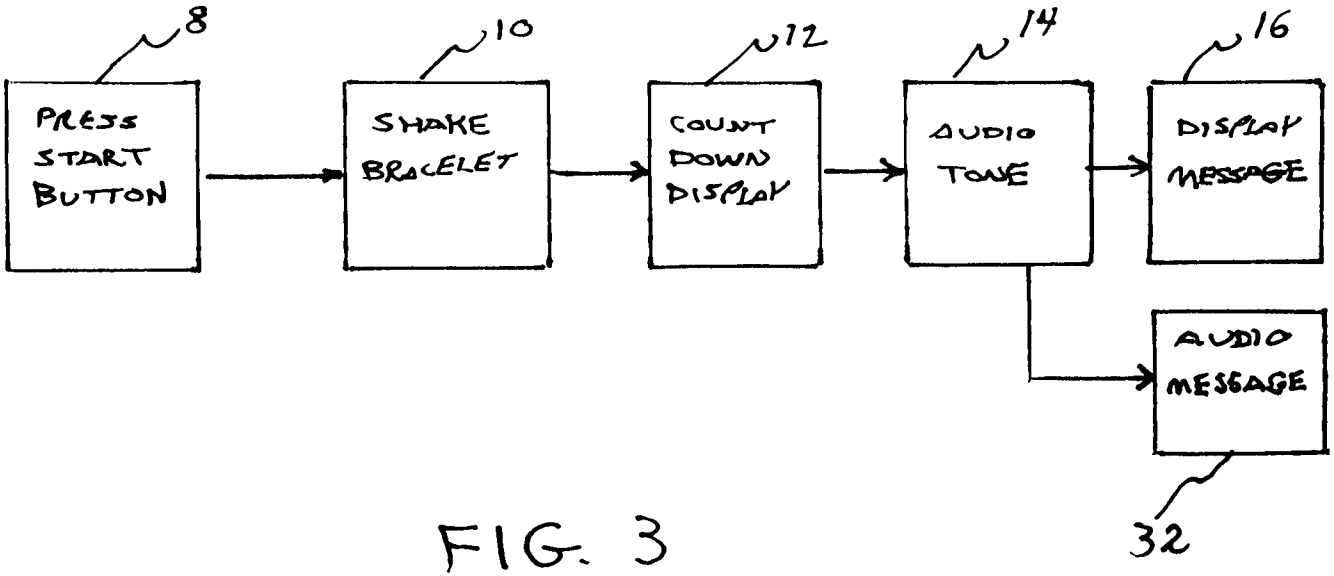
FIG. 3 is a block diagram showing sequence of events of the invention.

FIG. 3 is a block diagram showing the sequence of events of the invention 100 as described above. The sequence of events is as follows;

The user presses the start button 8, then shakes the bracelet 10 for a few seconds, then the display counts down 12 and an audio tone announces that the message is about to be shown 14. The message is displayed 16 on LCD display and may also be heard 32 through the miniature audio emitting device.

Figure 4:
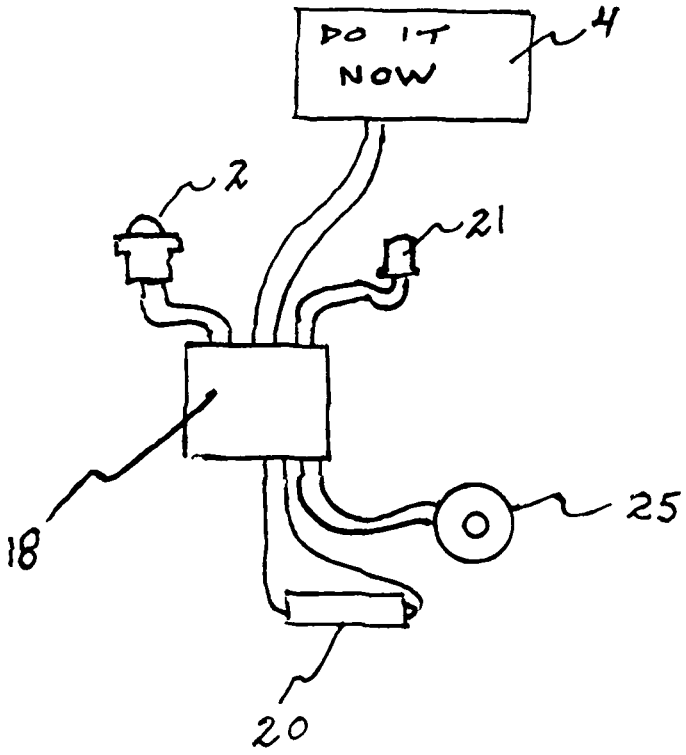
FIG. 4 is a schematic diagram of the invention.

FIG. 4 is a schematic diagram of the invention showing how all components including LCD display 4, momentary switch 2 battery power supply 20, tilt switch 21 and miniature audio speaker 25 are all electrically connected to microprocessor 18.

The present invention allows a novel way to obtain an answer to a question. The device is easy to access since it is light weight and worn on a user's wrist. The device uses inexpensive electronic components allowing it to be inexpensive to manufacture resulting in a relatively low retail cost to the consumer.

Other embodiments of the present invention can be considered obvious and in the spirit of the present invention. For example, the housing that includes all components can be worn as a pendant on a necklace. Or the housing that includes all components can be embedded in a decorative housing for use on a desk.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An answer bracelet comprising:

an approximately circular bracelet band suitable for wearing an a person's wrist;

a flexible elongated wrist band member;

a digital display member;

a microprocessor;

a printed circuit board;

a momentary start switch;

a motion sensing tilt switch;

a battery power supply;

a miniature audio emitting device;

a rigid hollow housing portion;

said elongated wrist band member terminating at each end in said rigid hollow housing portion;

said rigid hollow housing portion comprised of a top cover having a transparent viewing window, side walls and a removable and replaceable bottom cover;

said top cover having a first aperture for allowing sound to be emitted from said miniature audio emitting device within said housing and second aperture for allowing a push button of said momentary start switch to exit said top cover of said rigid hollow housing portion;

said digital display member visible through said transparent viewing window and mounted on said printed circuit board, both residing within said rigid hollow housing portion;

said bottom cover portion forming the underside of said rigid hollow housing portion;

said momentary start switch mounted on said printed circuit board and residing within said rigid hollow housing portion to one side of said digital display under said top cover portion;

said microprocessor electronically mounted to said printed circuit board and residing in said rigid hollow housing portion;

said battery power supply residing within said rigid hollow housing portion and providing electricity to electrical components residing within said rigid hollow housing portion and accessible by removing said bottom cover portion;

said audio emitting device mounted on said printed circuit board and residing in said rigid hollow housing portion;

said motion sensing tilt switch mounted to said printed circuit board and electrically wired to said microprocessor;

so that when a user presses said momentary start switch and shakes said bracelet, said motion sensing tilt switch sends a signal to said microprocessor whereupon said microprocessor instructs said audio emitting device to produce a short burst of sound which travels through an aperture in said top cover;

said microprocessor then randomly selects one of a plurality of messages stored in a memory portion of said microprocessor and displays a message on said digital display for a predetermined period of time and then said message disappears making said bracelet display ready for the next use.

2. The answer bracelet as claimed in claim 1, wherein said digital display is an LCD display.

3. The answer bracelet as claimed in claim 1, wherein said microprocessor also has stored audio messages that correspond with visual messages shown on said digital display and which are played through said miniature audio emitting device so that the user can hear said message as well as read it.

4. The answer bracelet as claimed in claim 3, wherein only an audio message is available without displaying said visual message.

5. The answer bracelet as claimed in claim 1, wherein said digital display acts as a standard time keeping device when not in use as an answer generating device.

6. The answer bracelet as claimed in claim 1, wherein said rigid hollow housing portion is attached to a necklace rather than being attached to said elongate flexible wrist band member.

7. The answer bracelet as claimed in claim 1, wherein said elongate flexible wrist band member is eliminated and said rigid hollow housing portion is embedded in a decorative housing capable of sitting on a desk or table.

* * * * *